US006158243A

United States Patent [19]

Couture

[11] Patent Number: 6,158,243

[45] Date of Patent: Dec. 12, 2000

[54] BUTTERFLY GEM

[76] Inventor: Guy Couture, 21 rue St-Paul, Ste-Brigitte-de-Laval, Canada, G0A 3K0

[21] Appl. No.: 09/103,688

[22] Filed: Jun. 10, 1998

[30] Foreign Application Priority Data

Jun. 11, 1997 [CA] Canada ..... 2206353

[51] Int. Cl.[7] ..... A44C 17/00

[52] U.S. Cl. ..... 63/32

[58] Field of Search ..... 63/32

[56] References Cited

U.S. PATENT DOCUMENTS

| | | | |
|---|---|---|---|
| 138,314 | 4/1873 | Bruhl | 63/32 |
| D. 209,771 | 1/1968 | Saltzman | 63/32 X |
| D. 250,100 | 10/1978 | Finker et al. | D11/90 |
| D. 324,003 | 2/1992 | Baranes | D11/90 |
| D. 340,669 | 10/1993 | Schachter | D11/90 |
| D. 390,155 | 2/1998 | Couture | D11/89 |
| 2,265,316 | 12/1941 | Schenck | 63/32 |
| 2,447,407 | 8/1948 | Grain . | |
| 3,796,065 | 3/1974 | Watermeyer | 63/32 |
| 3,835,665 | 9/1974 | Kitchel | 63/32 |
| 4,118,949 | 10/1978 | Grossbard | 63/32 |
| 4,118,950 | 10/1978 | Grossbard | 63/32 |
| 4,555,916 | 12/1985 | Grossbard | 63/32 |
| 5,072,549 | 12/1991 | Johnston | 63/32 X |
| 5,115,649 | 5/1992 | Amber | 63/26 |

OTHER PUBLICATIONS

Appraisal Document by Y. Morrier Gemmologist, Apr. 1997.

*Primary Examiner*—Lynne H. Browne
*Assistant Examiner*—Andrea Chop

[57] ABSTRACT

A cut stone having a crown (21) and a pavilion (23), the crown having peripherically four indents orientated face to face and forming a cross, the apparence of the crown of the stone forming a butterfly. The crown defines centrally a table in the shape of a reversed trapeze surrounded by facets defining two wings located toward the outside of the trapeze. The pavilion (23) comprises a number of facets distributed according to orientation angles combined to create a void of brilliance in the area of the indents. Under the table of the crown appears the reflection of the pavilion which uncovers two flapping wings located internally; the flapping wings added to the two wings at the exterior of the trapeze, give the appearance of a lepidopter.

17 Claims, 2 Drawing Sheets

BUTTERFLY GEM

SPECIFICATION

1. Field of the Invention

This invention is related to the field of stone cutting and of gemmology and particularly to the construction of a butterfly shape, and particularly with flapping wings.

2. Prior Art

Some patents have drawn our attention:

Des U.S. Pat. No. 340,669; Schachter; Oct. 26, 1993; shows a design of a precious stone. The general shape is octogonal.

Des. U.S. Pat. No. 324,003; Baranes; Feb. 18, 1992; shows a design for a gem. The general shape of the drown is trapezoidal: the long sides are angulated. The location of the angles of the body and of the crown do not permit the perceiving of a butterfly. If the top or bottom part were dug, one would alter the brilliance of the stone and one might not arrive at a butterfly. Furthermore the corners unveil positions of claws which are not diametrically opposed and which do not permit an equilibrated mounting.

U.S. Pat. No. 138,314 Bruhl, Apr. 29, 1873; utilizes an applique of precious stone superposed onto a base made of synthetic material. Multiple facets assure a brillance to the crown. No direction is given to the facets to create a special shape.

U.S. Pat. No. 2,447,407 Grain, Aug. 17, 1948; illustrate an internal opening to insert an intruder with some reflecting properties. There is an incision (20) in V having for goal to add to the reflection thanks to the sides of the incision; the method is not indicated to produce a precise shape like that of a butterfly, nor flapping wing shapes.

OBJECTIVES AND ADVANTAGES

There is a general objective of the invention to produce a stone almost alive in which one sees under examination flapping wings or other movement, without distorsion. A second objective is to provide a stone which has a trapezoidal crown, the sides having directional facets which allow the presence of a North-South reflectionless central location, so permitting the cutting of a location of separation between normal wings, as for a butterfly, without this separation causing a distorsion in the brilliancy, nor the appearance of an undesirable mark on the facets, which would depreciate the value and remove beauty from the stone.

A third objective is that the complete stone show itself as a butterfly.

A fourth objective is to let appear within the pavilion of the stone a simulation of the body of a butterfly and the normal separation and flapping of wings.

DRAWINGS

Presented herewith is an embodiment conform to the present invention, and with reference to the annexed drawing in which.

DESCRIPTION OF THE INVENTION

Figure 1:
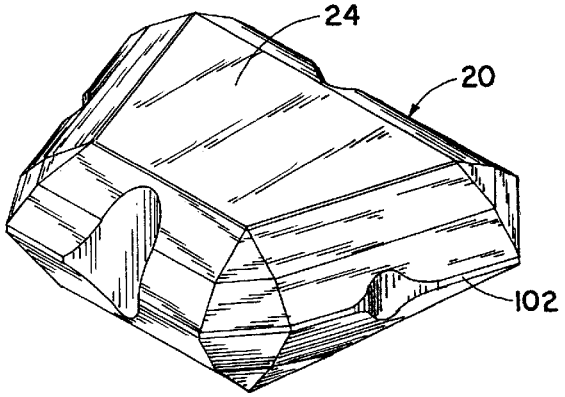
FIG. 1 is a perspective of a gem with butterfly appearance.

In the following description and in the drawings which accompany it, the same chracterizing elements are identified by the same numbers. The preferred embodiment of the invention is illustrated in FIG. 1 where one sees a cut stone 20 in perspective, with at the top a table 24 and around a facet line 102.

Figure 2:
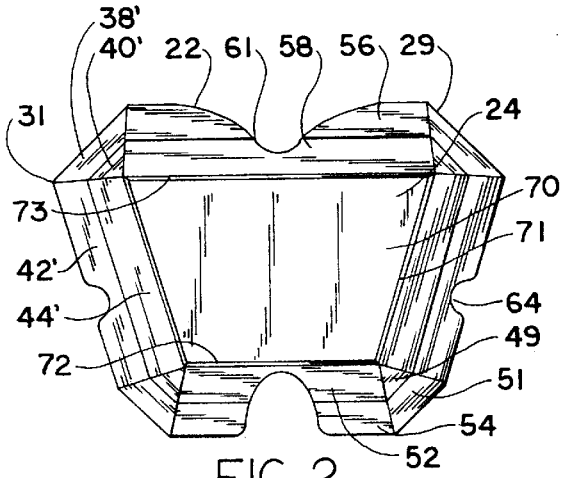
FIG. 2 is an upper view of the gem of FIG. 1.

FIG. 2 shows an external butterfly 22 delimited by the top view of the cut stone. One sees the table 24 of trapezoidal shape and reversed; in a corner one facet of lower claw 38', under a facet of upper claw 40', a facet of inferior side 42' under a facet of a superior side 44', a lower wing superior facet 52, a lower wing inferior facet 54, an inferior facet of top of wings 56, an upper wing superior facet 58, an upper wing separation cut 61, a wing side cut 64, a facet of first claw 49 and a facet of rest claw 51. One sees a left wing and a right wing 29 of the external butterfly.

Figure 3:
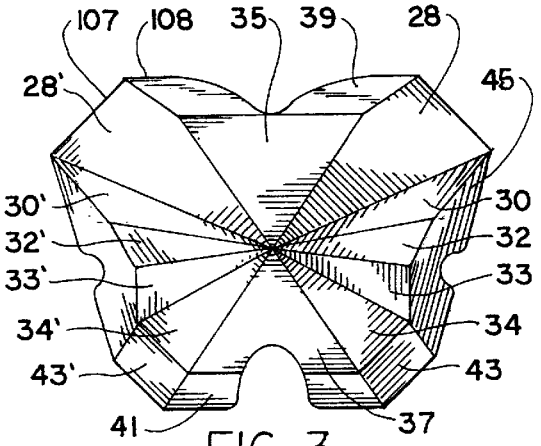
FIG. 3 is a bottom view like FIG. 2.

FIG. 3 shows a bottom view of a superior claw 28, a second corner 30, a central corner 32, a median corner 33, a bottom corner 34, a superior pavilion corner 35, an inferior pavilion corner 37, an edge of upper support 39 and of lower support 41, and an edge of inferior claw 43.

Figure 4:
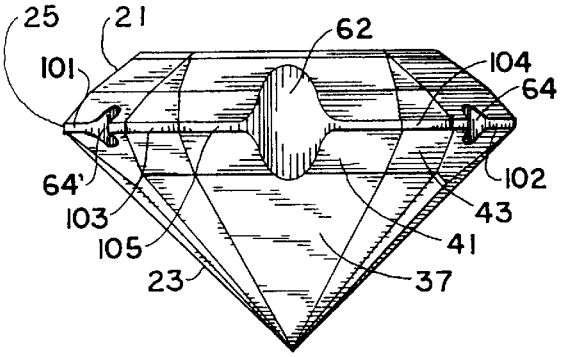
FIG. 4 is a front view, according to line 4—4 of FIG. 6.

FIG. 4 shows the wing side cut 64 in front view on the right, a corresponding wing side cut 64' on the left and a lower wing separation cut 62, as well as a face view of the inferior pavilion corner 37, an edge of lower support 41 and an edge of inferior claw 43. One also sees cutting edge facets which number eight 101, 102, 103, 104, 105, 106—FIG. 5—, 107, 108—FIG. 3—.

Figure 5:
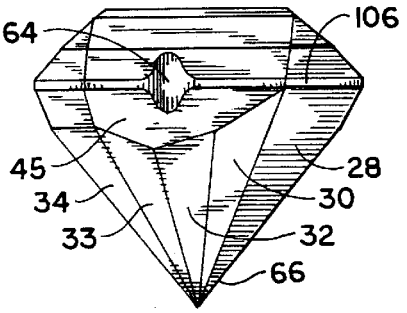
FIG. 5 is a side view, according to line 5—5 of FIG. 6.

FIG. 5 shows the wing side cut 64, a pavilion angle 66, a cutting edge facet 106 and a break facet 45.

Figure 6:
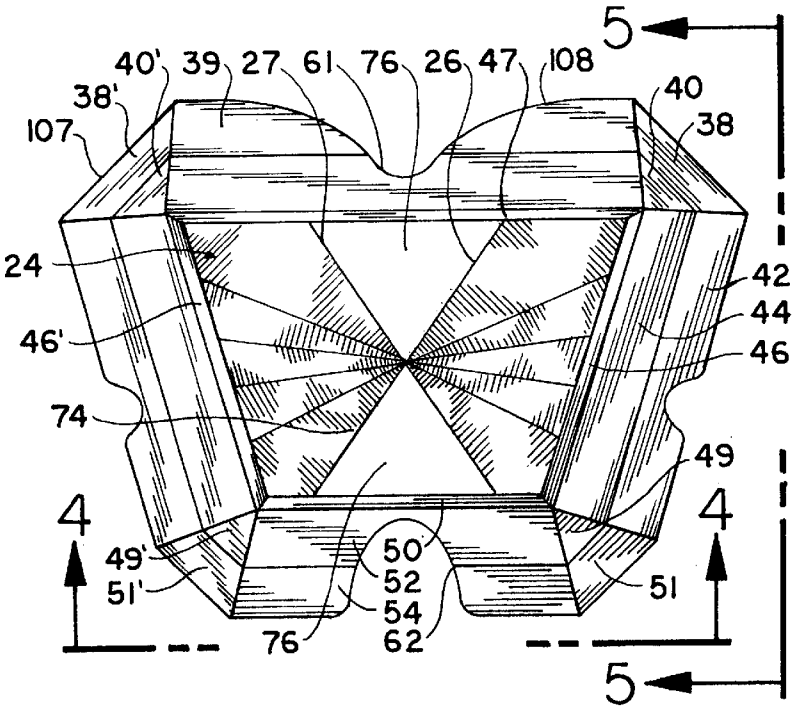
FIG. 6 is a view of FIG. 2, in transparency, through the table of the stone.

FIG. 6 shows, on a close look, the table 24 through which one sees an internal butterfly 74 with a interior right wing 26 and a left interior wing 27, a pavilion simulation 76 in X shape which serves as wing separation and as body shape for the two external butterflies 22 and internal 74.

The reversed right wing in relation to FIG. 3 comprises the facets of the superior claw 28', the second corner 30', the central corner 32', the median corner 33' and bottom the corner 34' and similarly for the left wing. The wing side cut 64—FIG. 2—is included to define the upper wings and the lower wings of the butterfly. The upper wing separation cut 61 and the lower wing separation cut 62 are needed to define the two parts of the stone, the left side and the right side of the external butterfly 22 with the external left wing 31, the external right wing 29. The lower wing separation cut 62 is located inside the limits of a non-reflective bottom zone 69 delimited by a dotted line—FIG. 7—at a location 96*.

One sees two side stars 46,46', an upper star 47, a lower star 50. One also sees corner edge facets 107, corresponding to the position at the extremity of the facet of superior claw 28' of FIG. 3 and 108 at the extremity of facet of edge of upper support 39, positionned respectively at the opposite of corner edge facets 105 and 104 of FIG. 4.

Figure 7:
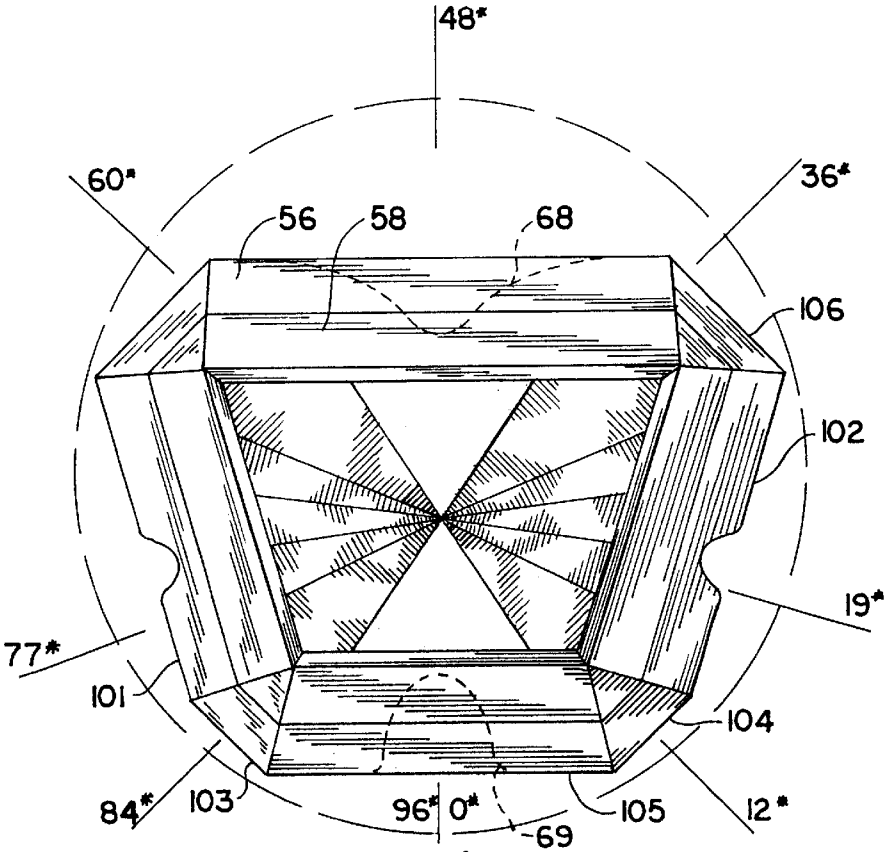
FIG. 7 is a to view of a trapezoidal stone, before cutting, two cuts appearing in a dotted line.

FIG. 7 shows a measuring index of the orientations of each of the facets, particuliarly those at the top. One uses an index of 96 locations, indicated 96*, around a circle of 360 degrees. At location 48* is found a upper wing separation cut 61 simulated by a dotted line and delimiting a non-reflection upper zone 68 and similarly at a location 96* where there will be a lower wing separation cut 62, references being:

48* location of a upper wing separation cut 61 and of the upper wing superior facet 58 at +0° angle, the inferior facet of wings top 56 at +9° angle, and

96* location of lower wing separation cut 62, and of the lower wing inferior facet 54—FIG. 6—at +9° angle, the lower wing superior facet 52 at +0° angle, The positions of other elements are:

36* location of the facet of upper claw 40 to +7° angle, and of the facet of lower claw 38, to the right, at +15° angle

60* location of facet of upper claw 40', at the left at a +7° angle and of the facet of lower claw 38', at the left at a +15° angle

12* location of facet of first claw 49, at the right at +1° angle and the facet of rest claw 51 at +9° angle;

84* location of facet of first claw 49', at the left, +1° angle and of the facet of rest claw 51' at +9° angle;

19* location of facet of inferior side 42, at the right at +5° angle

77* location of superior side facet 44', at +5° angle.

Four (4) facets of girdle 50, 46, 47, 46' are at locations 96*, 19*, 48*, 77* at a 26° angle.

METHOD OF EXAMINATION OF A STONE

A stone is regarded in two optical ways: in the inside (FIG. 6) and on the outside (FIG. 2). The position of the top facets and of the bottom facets are above the other between the top and the bottom, are responsible for seeing a butterfly, at the top, on the outside and one in the inside of the stone.

The internal butterfly of the stone moves the wings if one oscillates the stone; the wing movement is caused by the reflexion of the light coming from the facets in various locations and angles of the pavilion (23) and of the crown (21). This phenomenon that I have witnessed may be verified by gemmologists or by a user who oscillates the stone. The preferred position of the location of the facets of the two butterflies, one in the outside and the other on the inside of the stone as well as the position of the angles of the facets, as described in FIG. 7, enable to keep the brilliance of the stone to its maximum while seeing one or two butterflies. A dark or opaque stone lets see only the external butterfly. The same butterfly-gem may be fabricated with locations and angles close to a preferred position by ±20%.

The position and angle of the facets, the number and the shape of the facets can change without distorting the butterflies, either because of an index of refraction typical to a particular kind of stone, either because of proportions, or by design or other reason. For example quartz has an index of refraction of 1.544 to 1.522 and topaz of 1.619 to 1.627. Then the critical angle of topaz will be of 42° for the pavilion and of 41° for the crown. For quartz it will be 43° for the pavilion and 42° for the crown. The degrees described for the butterfly gem—FIG. 7—will be added to the critical angle of the stone.

Facets position in butterfly position enables a reflexion of the light in opposite positions, which means the butterflies facets seen on the inside and on the outside, to the right and to the left, reflect the light everywhere, without affecting the stone brilliance. The two internal wings added to the visible external wings, give the apparence of a lepidopter.

While using materials (stone or other), this cut stone enables a maximum brilliance, which only facet stones are capable of giving: taking the interior light and the exterior of those stones, and making obvious the flare of the stone, while representing butterflies, without being sculpted stones, because the sculptured stones enhance the external color only.

As a gemmologic reference, an analysis of the girdle has demonstrated that the equilibrium of the girdle of the stone is excellent and very representative of a butterfly; the ratio length/width is of 1.38 and the shape is very attractive; the analysis of the brilliance shows a window of 5%, an extinction of 10% and a return of light of 85%; the analysis of the profile has demonstrated that the equilibrium of the profile of the stone is excellent in the two directions. The total depth is of 62%, the ratio crown/pavilion is 1:3, the convexity of the pavilion is null, the dimension of the table is of 60% and the girdle presents an ideal thickness, that is at least 1 mm for a 15 carat stone approximatively. The disposition of the facets and their symetry are excellent. At first sight, one is seduced by the vivacity and the brilliance observed. With some imagination, one may at times see the flapping of the wings of the butterfly, when one moves the stone and observes the facets of the pavilion.

For general use, the butterfly gem adapts itself to the production of calibrated stones of small and medium sizes. The choice of a gamut of color stones (amethyst, citrine, tourmaline, garnet, topaz and diamond . . . ) is indicated. The butterfly-gem is calibrated stones can serve for producing necklaces, pendentives, bracelets, brooches, etc. and add to the beauty, especially if one considers the originality of the design. The butterfly gem can be cut in an exclusive manner or not. More, the butterfly gem thus realized enables the stones to be free from setting problems. The position of the wings top permits the location of the claws on a butterfly gem, claws which are opposed one to the other, for more solidity, to permit an equilibrium of forces when the stone is mounted and avoid breakage by pressure of the claws against the stone.

The position of the top of the wings facets enables the location of the claws, and better the final shape of the butterfly while giving more amplitude and beauty to the butterfly, contrary to conventional geometrical shapes, where claws deform the stones.

The position and the angle of facets form a natural window at the center of the separation of wings of the top and bottom of the butterfly: the dug out thus formed does not diminish brilliance, by cutting down the reflection of light, so this stone will keep all its value and its beauty. The two diggings more or less deep of the separation of side wings of the butterfly are in a precise spot which does not affect the brilliance thanks to locations 19* and 77* of facets 42, 42' of the crown which reflect directly on facets 45 et 45' located on the opposite site of the pavilion.

In the preferred embodiment, the dimensions of the table permits enjoying the brilliance of the internal butterfly and to maintain the shape of a butterfly; preferably the trapeze will be of maximal width equal to 1.65 times the height. The angle of the sides of the trapeze correspond to the location 19* namely 19/96 of 360°. The surface of the trapeze of the table represents about 60% of the total surface of the stone, as seen from above.

The precise position of facets of the butterfly is such that when one regards the butterfly centrally, the two wings shine at the same time and the two triangles of the body of the butterfly reflect differently to thus form the body of the butterfly. The diagram position and degrees can be flexible up to 20% and keep nevertheless the same appearance of a butterfly.

SUMMARY OF THE INVENTION

The preferred diagram for the butterfly gem is the one described and represents a butterfly on the inside, or one on the outside, or both. But one can use other similar diagrams or equivalents in terms of results, depending on which tool, which stone, or other ways to made the butterfly gem.

To position the facets one uses a circle of reference—FIG. 7—on an index of 360°; divisible, for example, into 96 locations designated by * in which the two positions of the top and the bottom will be of 48* and of 96*. So if one looks at FIG. 3, one may position thus the successive facets of the right side, once reversed, as for FIG. 7, according to the table which follows, while identifying the number of the facet, followed by the location on the index and by the angle inscribed on the table and which adds to the critical angle of the stone, ex.: for quartz 43°.

| Facet No. | Location | Angle |
|---|---|---|
| 24 | 96 | 45° with adaptator |
| 28 | 60 | +0° |
| 28' | 36 | +0° |
| 30 | 72 | −0, 5° |
| 30' | 24 | −0, 5° |
| 32 | 74 | +0° |
| 32' | 22 | +0° |
| 33 | 80 | +0, 5° |
| 33' | 16 | +0, 5° |
| 34 | 84 | +0° |
| 34' | 12 | +0° |
| 35 | 48 | +5° |
| 37 | 96 | +5° |
| 38 | 36 | +15° |
| 38' | 60 | +15° |
| 39 | 48 | +26° |
| 40 | 36 | +7° |
| 40' | 60 | +7° |
| 41 | 96 | +26° |
| 42 | 19 | +5° |
| 42' | 77 | +5° |
| 43 | 84 | +16° |
| 43' | 12 | +16° |
| 44 | 19 | +0° |
| 44' | 77 | +0° |
| 45 | 77 | +19° |
| 45' | 19 | +19° |
| 46 | 19 | +26° |
| 46' | 77 | +26° |
| 47 | 48 | +26° |
| 49 | 12 | +1° |
| 49' | 84 | +1° |
| 50 | 96 | +26° |
| 51 | 12 | +9° |
| 51' | 84 | +9° |
| 52 | 96 | +0° |
| 54 | 96 | +9° |
| 56 | 48 | +9° |
| 58 | 48 | +0° |
| 101 | 77 | 90° |
| 102 | 19 | 90° |
| 103 | 84 | 90° |
| 104 | 12 | 90° |
| 105 | 48 | 90° |
| 106 | 36 | 90° |
| 107 | 60 | 90° |
| 108 | 96 | 90° |

The facets of the butterfly gem may be increased in number or diminished, and the shape of the facets can change, while conserving the general shape of the butterfly. It is understood that when the term butterfly is used, it may represent any shape corresponding to the general shape of a butterfly.

It is understood that the mode of embodiment of the present invention which has been described herewith in reference to the annexed drawing, has been given as an indication and is non limitative and that modifications and adaptations may be brought about without departing from the object of the present invention. Other embodiments are possible and limited only by the scope of the following claims:

PARTS LIST

20. Cut stone
21. Crown
22. external butterfly
23. Pavilion
24. table
25. girdle
26. interior right wing
27. interior left wing
28. superior claw edge
29. right wing
30. second corner
32. central corner
33. median corner
34. bottom corner
35. superior pavilion corner
37. inferior pavilion corner
38. facet of lower claw
39. edge of upper support
40. facet of upper claw
41. edge of lower support
42. facet of inferior side
43. edge of inferior claw
44. facet of superior side
45. break facet
46. side star
47. upper star
49. facet of first claw
50. lower star
51. facet of rest claw
52. lower wing superior facet
54. lower wing inferior facet
56. upper wing inferior facet
58. upper wing superior facet
61. upper wing separation cut
62. lower wing separation cut
64. wing side cut
66. pavilion angle
68. non reflection upper zone
69. non reflective bottom zone
74. internal butterfly
76. pavilion simulation
101, 2, 3, 4, 5, 6, 7, 8 facets of girdle

What is claimed is:

1. A stone (20), having an outer perimeter and having a number of facets comprising a crown (21) and a pavilion (23), said pavilion having a central culet, and a plurality of triangular-shaped facets having an apex at the culet and which widen from the culet towards the outer perimeter of the stone, said crown comprising a table (24), said crown having sides joining with said pavilion and forming, with said pavilion, directional facets:

said table (24) defining a reversed trapezoidal figure having a widened upper part, said directional facets being oriented so as to concentrate brilliance towards two regions, on either side of said trapezoidal figure, said facets forming reflection planes such that when an observer inclines a reflection plane of said stone, the observer obtains a pattern of flapping wings, when looking inside said table, said facets further leaving a central location, under said crown, free from reflection, thus permitting an external cutting, within said central location, of two locations for separation of wings, a brilliance of said stone and of said facets permiting the appearance at a point of convergence between said pavilion and said locations for separation, giving said stone externally and internally the general shape of a butterfly.

2. The stone of claim 1 wherein each of said triangular-shaped facets (28, 30, 32, 33, 34) of said pavilion (23) are oriented at an angle different from each of the angles of said directional facets (43, 41, 35, 37) such that said brilliance alternately touches said directional facets.

3. The stone of claim 2 wherein said trapezoidal figure comprises two parallel sides and two converging sides defining said widened upper part, said two parallel sides having a distance of height and the two converging sides defining a wing span, said wing span varying between 1.1 and 1.7 times said distance of height.

4. The stone of claim 3 wherein said crown comprises two cuttings, carried out externally of said parallel sides of said table and two cutings disposed externally of said converging sides, said cuttings position suggesting a profile of a butterfly.

5. The stone of claim 4 wherein said sides of said crown comprise continuous facets of girdle (50,46,47,46'), and widening facets (42,44) attached to said facets of girdle, said cuttings being located in said widening facets.

6. The stone of claim 5 wherein said triangular-shaped facets are positioned to reflect a ray of light toward said converging sides of said crown, a concentration of light toward said converging sides defining said central location to permit forming a form corresponding to the general profile of a butterfly, within said stone.

7. The stone of claim 5 each triangular-shaped facet has an angle determine to allow return light from said table to said directional facets, thereby concentrating the brilliance to form said butterfly shape within said stone.

8. The stone of claim 7 further comprising pairs of supporting claw facets, said supporting claw facets accentuating said butterfly shape.

9. The stone of claim 8 wherein said supporting claw facets are positioned opposite, two by two, and centralized with respect to said culet to enable an equilibriated mounting and equal pressure on said supporting claw facets.

10. The stone of claim 7 wherein said girdle comprises locations on an index of 96* positions, from 12*, 19*, 36*, 48*, 60*, 77*, 84* et 96* with a variation of + or −20%.

11. The stone of claim 2 wherein said crown has a thickness and said pavilion has a depth, said thickness varying between ½ and ⅕ times said depth of said pavilion.

12. A stone made of a material having an index of refraction determining a critical cutting angle, said stone having a crown (21), and a trapezoidal table (24) disposed centrally of said crown (21), a pavilion (23) disposed under said crown, said critical angle when applied to facets of said pavilion permitting an observer to see a brilliance through said table, said trapezoidal table (24) having two converging sides (71), one at either side of the trapezoidal table, and two parallel sides (22), said pavilion (23) having a central culet, and a plurality of triangular shaped facets having an apex at the culet and which widen from the culet towards the outer perimeter of the stone, said facets comprising positive facets coinciding with said critical angle ±3 degrees and negative facets being at an angle equivalent to said critical angle +5 degrees±2 degrees, said positive facets being near said converging sides (71) and said negative facets being near said parallel sides (22), the return of light towards an observing eye caused by said positive facets, producing brilliance in the form of butterfly wings, said negative facets not returning light towards said eye, centrally of said wings.

13. The stone of claim 12 having a void of brilliance centrally of said parallel sides (22) and further comprising a dug out form (68, 69) within said void of brilliance, the combination of said facets and of said dug out form thus allowing said form of butterfly wings without altering the brilliance of said stone.

14. The stone of claim 13 wherein said void of brilliance is apparent to an observing eye when looking through said table, by a pair of triangles forming an X between them and whose apex of one of said triangles coincides with the apex of the other of said triangles.

15. The stone of claim 14 wherein said triangular-shaped facets are positioned within said pavilion (23) according to a first critical angle determined by a refractive index of said stone and oriented first in sequence starting from the left, a central edge (32') at said critical angle, a second edge (30') at said critical angle −0.5 degree, a superior claw edge (28') at said critical angle, a median edge (33') at said critical angle +0.5 degree and a lower edge (34') at said critical angle, an alternation of angles between sequential facets permitting an oscillation of brilliance giving the appearance of flapping of butterfly wings, when said stone is oscillated or inclined, said critical angle being variable within ±20%.

16. The stone of claim 15 wherein said crown (21) (FIGS. 6,7) comprises a second critical angle and crown facets (47, 46, 50, 46', 52, 54, 56, 58, 38, 40, 38', 40', 49, 51, 49', 51', 42, 44, 42', 44'), said second critical angle also determined by said refractive index, each of said crown facets being positioned in enhance brilliance already produced by said triangular-shaped facets of said pavilion.

17. The stone of claim 16 wherein said triangular-shaped facets of said pavilion (35,37,39,41,28,28',34,34',43,43',33, 33',32,32',30,30',45,45') are juxtaposed to said crown facets to form a fire of said stone caused by a reflection of light of said left hand facets onto said right hand facets and vice-versa, thus causing a brilliance void at a top and at a bottom of said stone.

* * * * *